US005196129A

United States Patent [19]

Luisi

[11] Patent Number: 5,196,129

[45] Date of Patent: Mar. 23, 1993

[54] STABLE, SINGLE-PHASED SOLUTIONS OF WATER-IN-OIL MICROEMULSIONS DERIVED FROM CRUDE OIL AND ALLIED PRODUCTS AND WHICH CONTAIN MICROORGANISMS AND/OR PARTS THEREOF

[75] Inventor: Pier L. Luisi, Zollikerberg, Switzerland

[73] Assignee: Eniricerche S.p.A., Milan, Italy

[21] Appl. No.: 550,573

[22] Filed: Jul. 10, 1990

[30] Foreign Application Priority Data

Jul. 17, 1989 [CH] Switzerland ..... 02751-89

[51] Int. Cl.[5] ..... C10M 173/00

[52] U.S. Cl. ..... 252/49.5; 252/312; 208/208 R; 44/301; 435/282

[58] Field of Search ..... 435/282; 44/301; 208/208 R; 252/49.5, 312, 309, 8.554

[56] References Cited

U.S. PATENT DOCUMENTS

| | | | |
|---|---|---|---|
| 2,975,103 | 3/1961 | Kirshenbaum | 435/282 |
| 4,632,906 | 12/1986 | Kopacz | 435/282 |
| 4,666,457 | 5/1987 | Hayes | 44/301 |
| 4,886,519 | 12/1989 | Hayes | 44/301 |
| 5,002,888 | 3/1991 | Kilbane, II | 435/832 |

OTHER PUBLICATIONS

Luisi and Laane, "Solubilization of Enzymes in Apolar Solvents via Reverse Micelles", *Trends in Biotech*, Jun. 1986 pp. 153-160.

Häring et al., "Solubilization of Bacterial Cells in Organic Solvents," *Biochem & Biophysical Research Comm, pp. 911-915, Mar. 1985.*

Darazon et al., "Transfer of Spores, Bacteria and Yeast . . . ", *Biochem & Biophysical Research Comm., pp. 1074-1080, Mar. 1988.*

Webster, *Chemical Engineering, Jun. 22, 1987, p. 17 "Microbes Successfully Remove Impurities from Synthetic Heavy Crude Oil"*.

Patent Abstracts of Japan, vol. 5, No. 120 (C-65) [792], 4th Aug. 1981.

*Primary Examiner*—Prince Willis, Jr.
*Assistant Examiner*—Thomas Steinberg
*Attorney, Agent, or Firm*—Oblon, Spivak, McClelland, Maier & Neustadt

[57] ABSTRACT

Stable, single-phased solutions of water-in-oil microemulsions which contain microorganisms and/or parts thereof are described. They are obtained by adding to crude oil and/or at least one product of the refining of same an aqueous concentrated solution of microorganisms and/or parts thereof, in such a way that said aqueous solution is solubilized in crude oil or the refined product and that the blend thus obtained has the form of a stable, single-phased solution.

19 Claims, 4 Drawing Sheets

(Single phase)

(2 phases)

STABLE, SINGLE-PHASED SOLUTIONS OF WATER-IN-OIL MICROEMULSIONS DERIVED FROM CRUDE OIL AND ALLIED PRODUCTS AND WHICH CONTAIN MICROORGANISMS AND/OR PARTS THEREOF

This invention relates to stable, single-phased solutions of microorganism-containing water-in-oil microemulsions, which are obtained from crude oil or crude-oil derivatives.

In order to remove sulphur-containing products from crude oil, naphtha and derivatives, attempts have been made long since to find microbiological procedures. As microorganisms, as can be seen, for example in a comprehensive paper published in 1978 by Malik (ref.(1) at the end of the present specification), lend themselves *Desulfovibrio desulfuricans*, Arthrobacter sp., Pseudomonas sp., *Pseudomonas aeruginosa*, Acinetobacter sp., Rhizobium sp.

Later, also *Pseudomonas alcaligenes, Alcaligenes denitrificans, Solfobolus acidocaldarius, Thiobacillus ferroxidans* have been proposed (ref.2–6).

The problem of removal of sulphur from crude oil is connected with that of removal of sulphur from coal, and the above cited literature references (1–6) and in other references (7,8) this subject matter is thoroughly discussed. A comprehensive article by Andrews and Maczuga discusses this problem.

Inasmuch as nearly all microorganisms, and thus also the ones referred to above, can survive in crude oil poorly, the rule is to work in a two-phased system, wherein the microorganisms are introduced into an aqueous phase which is immiscible with crude oil. The reaction takes place at the interface, so that it is necessary to renew such contact surfaces continuously with a vigorous stirring.

A new interesting paper on the argument of the biphasic systems has appeared recently (ref.6). In such case the authors use in the organic phase a capillary-active agent (Tween 80, Reg.Trade Mark), a polysorbate which possesses the capability of building reversible micellae within organic solvents. They achieve thereby a significant success in removing sulphur from coal. The authors, however, warn that enzymatic preparations are much more efficient than the corresponding microorganisms as such (ref.6).

It would be an asset, of course, for the microbiological demolition, should one be enabled to work within a single homogeneous phase, rather than within a biphasic system. This means, however, to find conditions under which the microorganisms, scattered throughout the crude oil homogeneously, are present in solution.

The solubilization of water-soluble proteins and other biopolymers in organic solvents by the agency of reversible micellae or water-in-oil microemulsions, is known a few years since (ref.9,10).

Contrary to the normal aqueous micellae, the reversible micellae are formed in apolar solvents. To this end capillary-active agents are employed, which form spheroidal aggregates, in which the polar heads of the molecules of the capillary-active agent form a polar core. In such a core it is possible to solubilize water (Water pool). Whenever the water content in a ternary system is comparatively high, water-in-oil microemulsion is spoken of, and reversible micellae are no more mentioned.

However, in the common practice, the difference between the two fields has not been made quite clear. The invention is illustrated by the accompanying drawings, wherein.

Figure 1B:
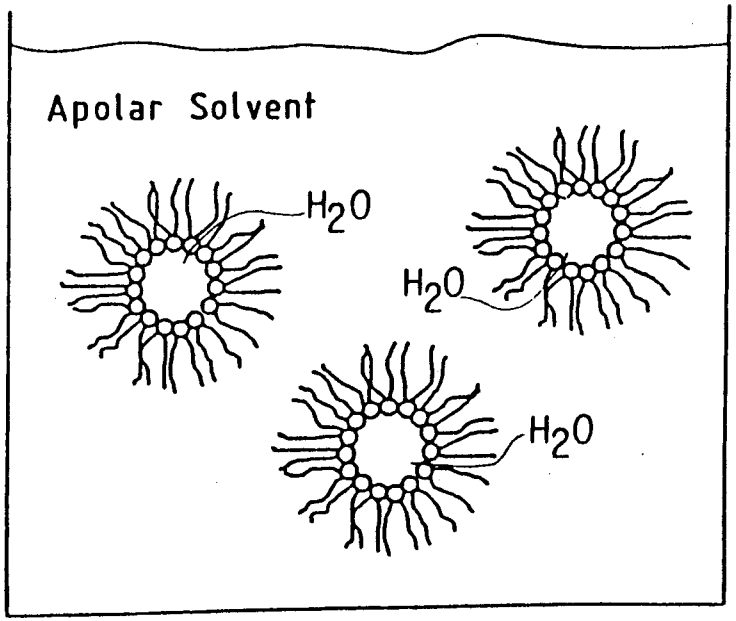
FIG. 1 is a diagrammatical showing of (a) normal, i.e. aqueous micellae, and (b) reversible micellae.
Figure 1A:
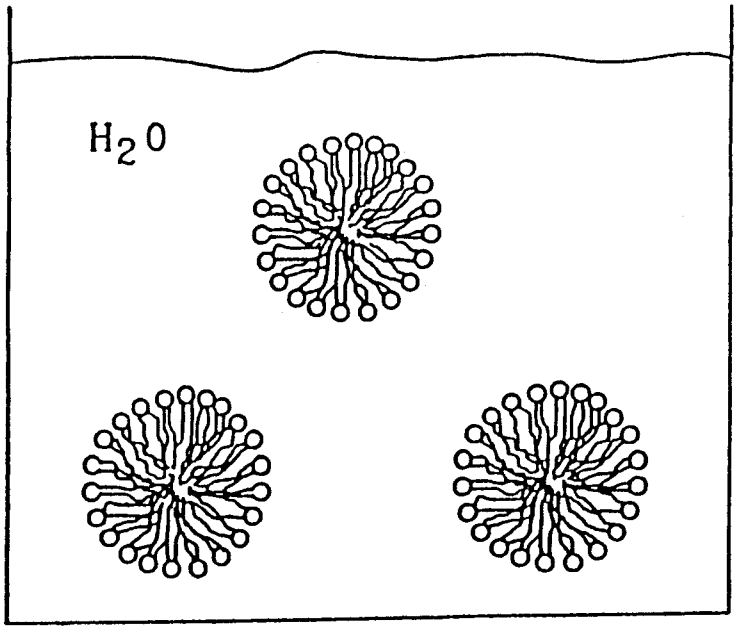

The difference between the normal, i.e. aqueous, micellae (a) and the reversible micellae (b) is shown in FIG. 1 of the accomanying drawings.

The water pool in the reversible micellae, or in the water-in-oil microemulsion, is of outstanding importance, because it becomes possible to dissolve biopolymers in such water droplets in a secondary solubilization process. Thermodynamically stable solutions are obtained, which are clear, and in which the enzymes retain their activity.

Figure 2:
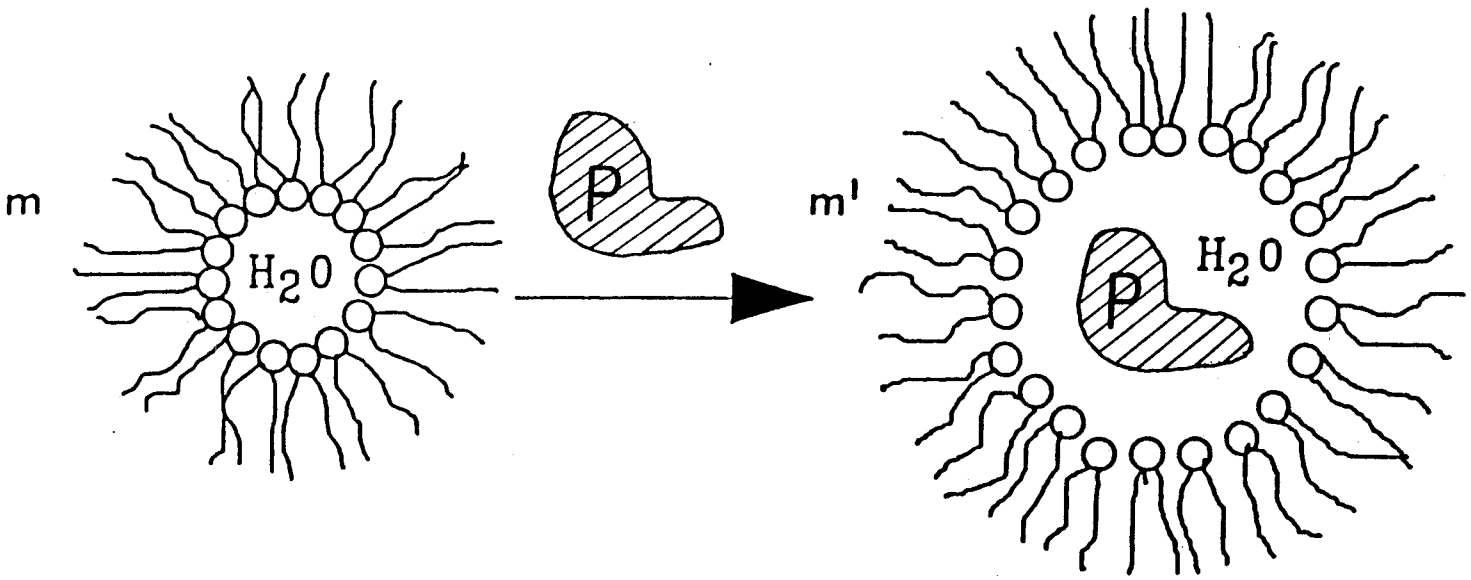
FIG. 2 is a diagrammatical showing of the introduction of a protein in the "water pool" (aqueous core) of reversible micellae.

A graphic representation of the solubilization process referred to above is presented in FIG. 2.

In recent years it has also been made known that *E. coli* bacteria and other small bacteria could be solubilized in the solvent isopropyl palmitate (IPP) by the agency of the capillary-active agent TWEEN (reg.-Trade Mark)(ref.11).

Within a solution of the capillary-active agent TWEEN 85 (Reg.Trade Mark) in IPP, reversible micellae are formed at the outset, whereafter a small volume of a microorganism-containing aqueous solution was added. Whenever the concentration of the bacteria and/or the volume of water is not too high, the result of this procedure is a clear solution, in which viable and active bacteria can be detected.

The same group of searchers has subsequently solubilized also mitochondria in the same system (ref.12). Later, it has been announced by a Group in Mexico (ref.13) that it is possible to solubilize spores, bacteria and yeast cells in toluene, and this with phospholipids as the capillary-active agents, however with a restricted viability of the cells.

All the studies referred to above on bacteria in a homogeneous phase are restricted to few conventional organic solvents; crude oil and other naturally occurring oils have not been mentioned heretofore.

The objective of the present invention is thus to improve the state of the art referred to above, and to provide stable, single-phased solutions of water-in-oil microemulsions which contain microorganisms and/or parts of microorganisms.

The invention is defined by the characteristics reported in the independent claims. Preferred embodiments of this invention are defined in the dependent claims.

The main characteristic of the present invention consists in that conditions have been found in which bacteria, yeast cells and other microorganisms can be solubilized in crude oil, that is in such a way they do not decay for longer times, independently of the selected system. The microorganisms are introduced in the form of an aqueous solution (e.g. with a microspray, the technique of the internal spraying), and the water is completely solubilized by the crude oil.

The situation in the case of the solubilization of proteins can be diagrammatically represented: see FIG. 2. It is really surprising that the cells remain in solution since it would be forecast that they, due to their size should show a tendency towards sedimentation from the solution already after a short time, due to the gravity pull, and towards aggregation. Without being bound to any special theory, it is surmised that the stabilization of the microorganisms in solution is to be construed as a consequence of the formation of a microemulsion: the microorganisms, particularly the bacteria, which are present in the water droplets, are a component part of the water-in-oil microemulsion system, and clearly remain blocked in the organic solution as guest-compounds in the stable aggregates which are geometrically closed by the capillary-active agent molecules.

Presumably, the bacteria are protected by a few water layers and by a layer of capillary-active agent molecules, whereby the solubility in an organic medium is made possible.

Figure 3B:
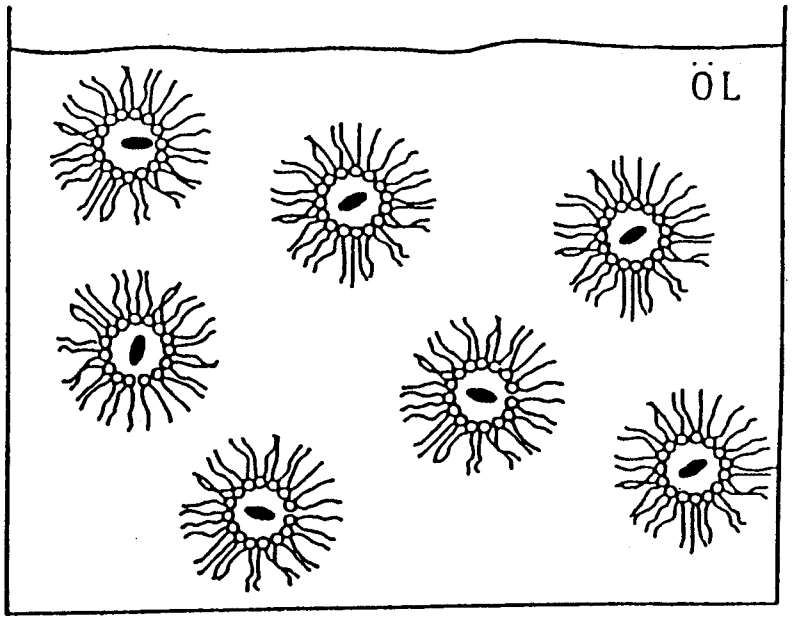
FIG. 3 depicts the difference between a bacteria-containing biphasic system (a) and the corresponding single-phase system (b)
Figure 3A:
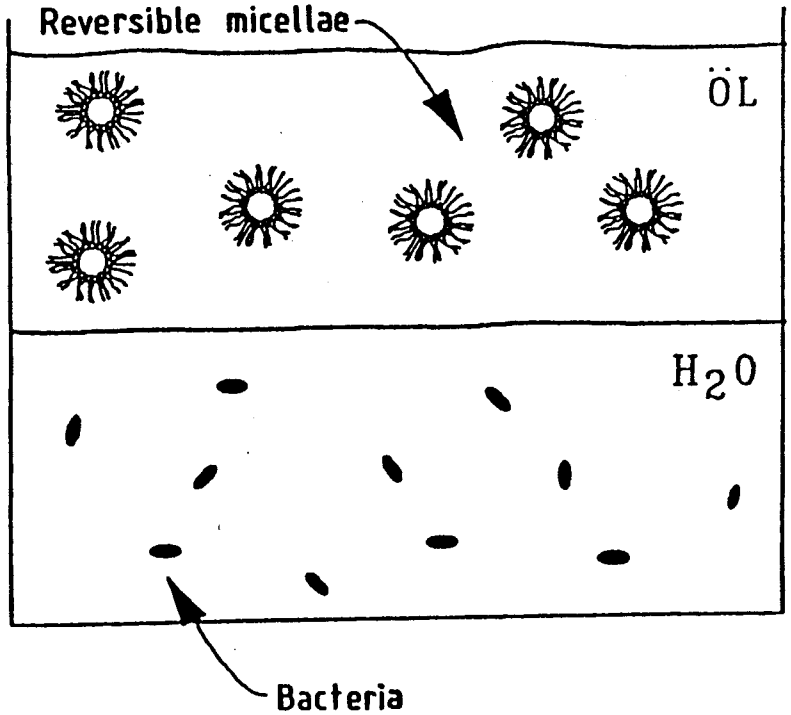

FIG. 3 tenders a graphic representation, which, however is to be construed merely diagrammatic, inasmuch as accurate experimental data on the structure of the micellar aggregates of bacteria are not yet available. The special difference in density between microorganisms and solvents, and the advantageous value of the increment of the count index, dn/dc, contribute to a degree towards the optical clarity and the reduction of the dispersion of light.

As outlined above, all the factors contributing towards the formation of clear solutions of microorganisms (bacteria and eukariotic cells), must be still closer investigated. The solutions prepared according to this invention are stable, transparent and homogeneous single-phased systems.

It is important to emphasize that, in the solutions made according to this invention, contrary to the Kwang-II Lee and Teh Fu Yen system (ref.6), no biphasic system is formed. According to Kwang-II Lee et al., the bacteria are not solubilized in the micellar phase, but, rather, they are present in the aqueous phase (see FIG. 3*a*). A diagrammatical showing of the difference between the two systems is reproduced in FIG. 3.

It is likewise important to add that, under the conditions selected by Kwang-II and Teh Fu, the bacteria cannot be conveyed in the supernatant phase, that is to say that in the a) system it is not possible to directly obtain a situation such as that corresponding to what is represented at b).

For these reasons the two procedures are substantially and radically different from one another.

According to the present invention, different types of bacteria are solubilized in crude-oil products, by the agency of different capillary-active agents, e.g. Tween 85 and Asolecthin. In the absence of capillary-active agents and/or water, no solubilization occurs; one obtains a suspension of cells, which segregate comparatively rapidly.

Capillary active substances may be selected from anionic, cationic, neutral and zwitter-ionic capillary active substances. More specifically suitable substances may be BRIJ (a mixture of polyoxyethylene ethers of higher aliphatic alcohols), TWEEN (a polysorbate), SPAN (a sorbitan ester), lipids such as lecithin, ASOLECTIN (a mixture of phospholipids), AOT (bis(2-ethylhexyl)sodium sulfosuccinate) and ammonium compounds. A co-capillary active substance may also be added selected from the group of fatty acids, alcohols and halogen containing compounds in an amount from 0.01-1,000% preferably 0.1-100% relative to the weight of the capillary active substance.

It had been established that, in the case of certain defined types of crude oil, which, as a rule, occur in the form of a black suspension and usually contain many compounds, capillary-active agents should not be introduced, absolutely. Stated another way, it is permissible to add directly to the oil, without any special pre-treatment, an aqueous microorganism-containing solution. Without being bound to any special theory, it is surmised that this circumstance is presumably to be attributed to the fact that crude oil already contains molecules which are similar to those of the capillary-active agents.

This observation is of course very important from the biotechnological standpoint, because, on its basis, the potential process of the microbiological decomposition of crude oil would become much cheaper and simpler. Water, however, must be added also in such a case. In order that a single phase might be obtained, it is important that the volume of the added aqueous solution should not overtake the limits of the thermodynamic stability of the microemulsion system, or, stated alternatively, if too much water is added, a biphased system is obtained.

A suitable microemulsion may be prepared from 100 parts crude oil with 0.001-100 parts by volume of aqueous solution.

It has been quite surprisingly ascertained that many microorganisms, which are contained in the solutions prepared according to this invention, are in a position to carry out microbiological reactions even in an environment unfavourable to life, such as crude oil doubtless affords.

Thereby the basic principles are provided for carrying out microbiological processes in crude oil and in the products of its refining.

The crude oil may be blended with an organic solvent such as aromatic hydrocarbons, aliphatic hydrocarbons, fatty acid esters, alcohols, halogen-substitute compounds, benzene, toluene, cresol, pentane, octane, dodecan, fluorinated compounds, and perfluorinated compounds or vegetable oil such as soybean seed, sunflower seed, cotton seed, or olive oil.

In a first stage of the programme, experiments have been conducted, the aim of which was to determine that bacterial cells can be directly solubilized in mineral oil or in naphtha, and that such single-phased systems are stable, that is, that they do not bring about any phase splitting, even when the system is not shaken. In a second stage, the viability of the microorganisms in such systems was investigated.

Both these stages of the programme are described hereinafter.

FIRST STAGE: PREPARATION OF A SINGLE-PHASED SYSTEM

Typically, 500 mg of TWEEN 85 or 250 mg of ASOLECTHIN were solubilized in 5 ml of a crude-oil product at room temperature and with vigorous stirring (10% or 5% weight/volume, respectively. The aqueous suspension of the cells was adjusted with an appropriate nutrient medium for the microorganism concerned, to a concentration (typically) of $10^8$cells/ml. With a microspray a small volume of this solution (about 2% v/v) of the organic capillary-active agent solution was added, and vigorously shaken (about 1600 rpm). Shaking was discontinued after a few minutes. With larger cells, a short ultra-sound treatment may shorten the shaking run. The solubilization of cells in crude oil without capillary-active agent added follows in the abovementioned way. By varying the water concentration, it is possible to determine the limits for building a homogeneous phase.

It has been ascertained that in motor oil (Tellus 33, Shell) it is possible to solubilize up to about 1% of water (v/v); in the case of crude oil, it is possible to add up to the double volume of water, but it is to be mentioned that the opacity of the product hardly permits that a clear boundary may be detected.

In this manner the micellar solutions of motor oil and mineral oil contain from about $10^6$ to $10^7$ cells/ml (counted relative to the total volume).

It is possible to go beyond these limits, while still having a single-phased system, if a greater concentration of capillary-active agent is employed, e.g. in the case of Asolecthin, one can solubilize twice more water by doubling the concentration of the capillary-active agent and, thereby, add more cells correspondingly.

In this connection, attention is also directed to the fact that, above a certain cell concentration, the solution becomes saturated, that is to say that the redundant cells will precipitate.

Obviously it is possible to operate also microbiologically under such conditions, but no solution is obtained any more, but a suspension. Such a system could be employed technologically, but it is necessary to shake vigorously; so as to keep all the cells in contact with the solvent, and so one falls into the situation of the biphasic system once again.

With the procedure as outlined above, the following microorganisms were investigated: Bakers' yeast, Pseudomonas sp., Sulfolobulus, Thiobacter sulfoxidans, Bac.subtilis, Arthrobacter spp.HAl, the details of which are reported in the examples.

Other suitable bacteria include *Thiobacillus ferroxidans, Sulfolobus acidocaldarius, Pseudomonas alkaligenes, Pseudomonas janii, Pseudomonas abikonensis, E. coli, Alkaligenes denitrificans, Desulfobibrio desulfuricans.*

All of these solutions remain stable, that is, there is no sign of phase splitting, and, moreover, no significant precipitation of the cells was observed along a few weeks.

SECOND STAGE: DETERMINATION OF THE VIABILITY OF THE MICROORGANISMS IN CRUDE OIL PRODUCTS

The objective of this work consists in investigating the viability of the microorganisms in the systems obtained in the above indicated way.

To this end, the activity of the microorganisms is tested on agar plates: the concentration of the viable cells is determined by smearing with a crude oil microemulsion, previously diluted with 0,9% aqueous NaCl, a measureable number of cells (about 100 per each Petridish). 100% viability corresponds to the cell concentration at the start (t=0).

Figure 4:
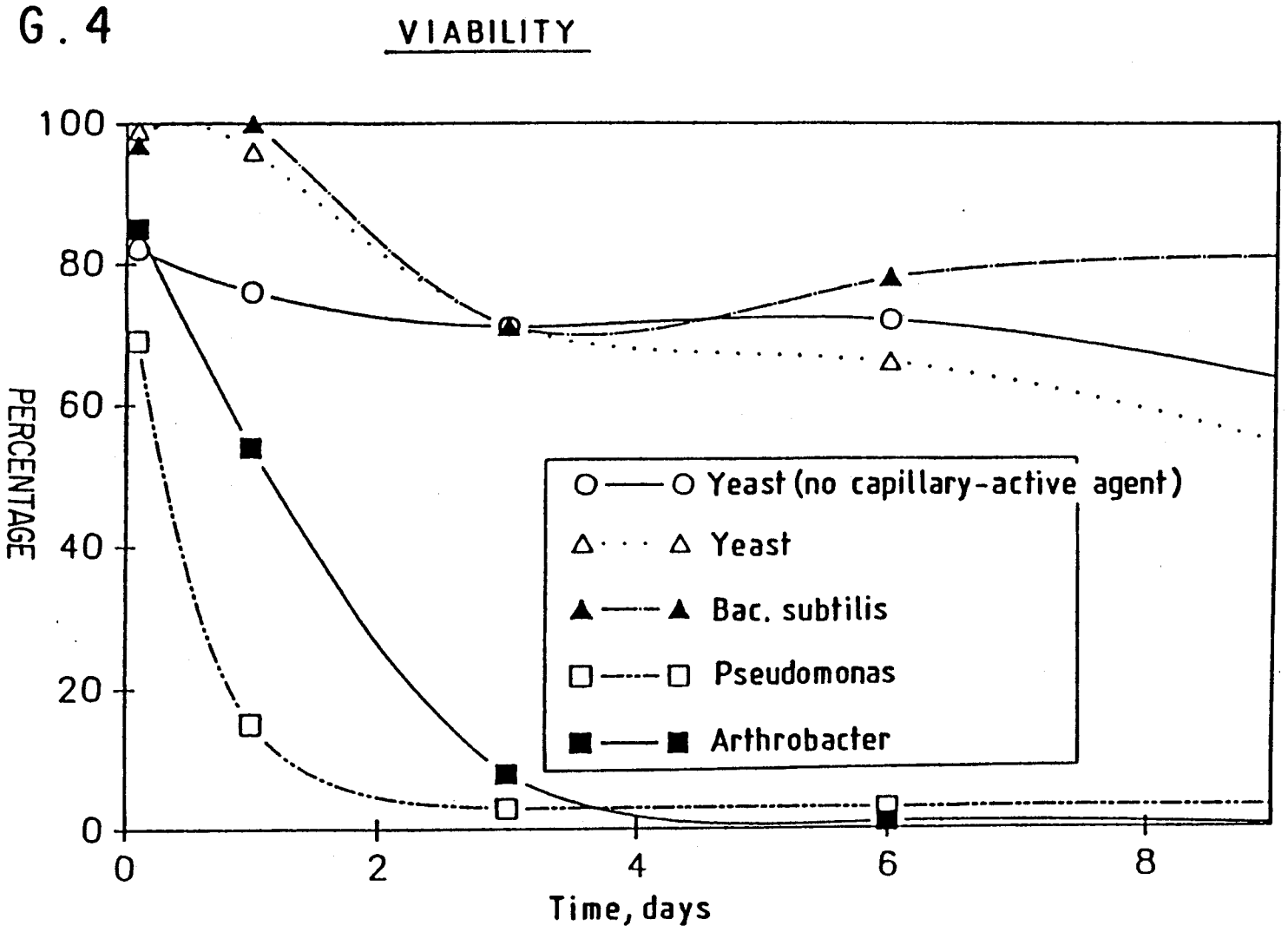
FIG. 4 shows the stability of cells solubilized in crude oil by means of ASOLECTIN, a mixture of phospholipids (65 mM) and water (1M) as explained in the examples.

Typical results are shown in FIG. 4. It can be seen that the different bacteria and cells differ from each other as to stability, but the viability in many cases is designated as very good. Details can be found in the description of the Figure or the examples.

The important features of the present invention can be summarized as follows:

A process is proposed, which makes it possible to dissolve microorganisms, preferably bacteria, in an aqueous phase in mineral oil, so as to obtain a single liquid phase, for which microorganisms do not precipitate during a long time. Capillary-active agents are preferably used (e.g. Tween or lipids), which are solubilized in crude oil or in a product obtained by refining, where in the case of raw oil it is possible to work also without any addition of capillary-active agents.

Contrary to other processes provided in the literature, the process proposed herein is characterized in that the microorganisms which are present in crude oil are in a microemulsion, which brings about an efficient contact with the solvent. Inasmuch as a single liquid phase is in the question, no stirring is potentially required to secure a reaction of the microorganisms with the compounds which are present in the crude oil.

The invention makes it possible to treat microbiologically a crude oil preparation under a stationary condition.

Among others, those microorganisms are solubilized in crude oil, which are capable of demolishing sulphur-containing products. Possible chemical demolition processes and the appertaining reactions are the target of further reasearch work.

It is moreover shown that the viability of the microorganisms can be extended for weeks, and that, during such a time, no significant precipitation of the cells can be observed.

EXAMPLES

EXAMPLE 1

100 mg of yeast are suspended in 1 ml of nutrient medium (YPD, consisting of 1% yeast extract, 2% bacteropeptone, 2% glucose in water). 100 microliters of the suspension are sprayed in 5 ml of crude oil and stirred at 1600 rpm for about half an hour, until obtaining a homogeneous phase.

EXAMPLE 2

The yeast is processed as outlined above and the same volume is transferred into 5 ml of a solution of crude oil with 10% TWEEN 85, and stirred to homogeneousness just as in Example 1.

EXAMPLE 3

The same procedure as in Example 1 is followed, with yeast in a solution of 250 mg of ASOLECTHIN in 5 ml of crude oil.

EXAMPLE 4

The same procedure as in Example 1 is adopted, with yeast in a solution of 250 mg of ASOLECTHIN in 5 ml of Tellus 33 motor oil (Shell).

EXAMPLE 5

The same procedure as in Example 1 is followed, with yeast in a solution of 250 mg TWEEN 85 in 2,5 ml of isopropylpalmitate, which is mixed with 2,5 ml of Tellus 33 motor oil (Shell).

EXAMPLE 6

From a solution of 30 mg/ml of Pseudomonas sp. in a nutrient medium, 100 microliters are added to a solution of ASOLECTHIN/crude oil. (Procedure as in Example 3).

EXAMPLE 7

The same volume of a spore solution of the Bacillus subtilis is solubilized as in Example 6 or Example 1 in Asolecthin/crude oil.

EXAMPLES 8-10

As described in Example 6, Arthrobacter spp. (grown for 2 days from butanol), Sulfolobus Acidocaldarius and Thiobacillus sulfoxidans can likewise be introduced.

LITERATURE REFERENCES

1) K. A. Malik, Process Biochemistry, September 1978S. 10
2) F. Kargi, Enz. Microbiol. Techn., 4, (1982) 13
3) F. Kargi and J. M. Robinson, Biotech. Bioengen. 26 (1984) 687
4) F. Kargi and J. M. Robinson, Appl. Environ. Micorb. 44, (1982) 878
5) M. Van Afferden, S. Schacht, M. Bayer, J. Klein, in "Bioprocessing of coal", K. S. Vorres edito., 196th. ACS National Meeting, Am. Chem. Soc. Div. Fuel Chemistry, vol 33 (1988), 561
6) Kwang-Il Lee and Teh Fu Yen, Prepr. Pap.-Am. Chem. Soc., Div. Fuel Chem., vol 33 (1988) 572
7) M. R. Hoffmann, B. C. Faust, F. A. Panda, Honf H. Koo, and H. M. Tsuchiya, Appl. Environ. Micorbiol. 42 (1982) 259
8) G. W. Andrews, J. Maczuga, in: "Bacterial Coal Desulfurization", 4.th Symposium Biotechn. Energy Prod. and Conversion, Gallinburg, Tenn. (1982)
9) P. L. Luisi, and C. Laane, Trends in Biotechn., 4 (1986) 153
10) P. L. Luisi und L. Magid, Critical Rev. Biochem. 20 (1986) 409
11) G. Häring, P. L. Luisi and F. Meussdörffer, Bioch. Bioph. Res. Comm. 127 (1985) 911
12) G. Häring, A. Pessina, F. Meussdörffer, A. Hochköppler and P. L. Luisi, Ann. of the New York Acad. of Sci., 506 (1987) 337
13) A. Darzson, E. Escamilla, A. Gomez-Puyou and M. Tuena de Gomez-Puyou, Biochem. Bioph. Res. Comm. 151 (1988) 1074

We claim:

1. A stable water-in-oil microemulsion which contains microorganisms for carrying out microbiological processes obtained by adding to crude oil an aqueous, concentrated solution of microorganisms selected from the group consisting of bacteria, animal and vegetable cells in such a way that said aqueous solution becomes solubilized in said crude oil, the thus-prepared blend being in the form of a stable water-in-oil microemulsion.

2. The microemulsion of claim 1, characterized in that at least one capillary-active substance is dissolved in crude oil.

3. The microemulsion of claim 2 wherein said capillary-active substance is present in the proportion of from 0.1% to 30% by weight relative to the weight of the crude oil.

4. The microemulsion of claim 2, wherein said capillary-active substance is present in the proportion of from 0.5% to 15% by weight relative to the weight of the crude oil.

5. The microemulsion according to claims 1 or 2, characterized in that said capillary-active substance is selected from the group consisting of anionic, cationic, neutral and zwitter-ionic capillary-active substances.

6. The microemulsion of claim 5, wherein said capillary-active substance is selected from the group consisting of polyoxyethylene ethers of higher aliphatic alcohols, polysorbates, sorbitan esters, lipids, lecithin, a mixture of phospholipids, bis(2-ethylhexyl sodium) sulfosuccinate and, ammonium salts.

7. The microemulsion of claim 1, wherein said bacteria possess a reducing or an oxidizing action toward sulfur-containing products.

8. The bacteria of claim 1, wherein said solution is selected from the group consisting of *Thiobacillus ferroxidans, Sulfolobus acidocaldarius, Pseudomonas alkaligenes, Pseudomonas janii, Pseudomonas abikonensis, E. coli, Alkaligenes denitrificans, Desulfobibrio desulfuricans*, Arthrobacter spe., photosynthetic bacteria and Cyanobacteria.

9. The microemulsion of claim 1, wherein said animal or vegetable cells are yeast cells of the different strains, which possess a demolishing activity or a transposition capability toward aromatic compounds.

10. The microemulsion of claim 9, wherein said yeast cells are selected from the group consisting of *Saccharomyces cerevisiae* and *Candida utilis.*

11. The microemulsion of claim 1, characterized in that the parts of microorganisms are selected from spores, heterocysts and organellae of the microorganism cell.

12. The microemulsion of claim 11, wherein said organellae of the microorganism cell is selected from the group consisting of mitochondria, microsomes and lysosomes.

13. The microemulsion of claim 1, characterized in that at least one co-capillary-active agent is added to the capillary-active substance.

14. The microemulsion of claim 13, wherein said co-capillary-active agent is selected from the group consisting of fatty acids, alcohols and halogen-containing compounds.

15. The microemulsion of claim 13, wherein said co-capillary-active agent is in an amount of 0.01-1,000% relative to the weight of the capillary-active substance.

16. The microemulsion of claim 13, wherein said co-capillary-active agent is in an amount of 0.1-100% by weight relative to the weight of the capillary-active substance.

17. The microemulsion of claim 1, characterized in that in 100 parts by volume of crude oil and from 0.001-100 parts by volume of said aqueous solution are present.

18. The microemulsion of claim 1, characterized in that said aqueous, concentrated solution additionally contains nutrients and salts for the microorganisms.

19. A process for preparing a stable water-in-oil microemulsion which contains microorganisms for carrying out microbiological processes selected from the group consisting of bacteria, animal and vegetable cells, comprising;

adding a concentrated aqueous solution of microorganisms, to crude oil, such that said aqueous solution becomes solubilized in said crude oil and so that the prepared blend has the form of a stable, water-in-oil microemulsion.

* * * * *